US005762586A

United States Patent [19]

Lepre

[11] Patent Number: 5,762,586

[45] Date of Patent: Jun. 9, 1998

[54] EXERCISE APPARATUS ACCESSORY

[76] Inventor: Gennaro Lepre, 200 Baldwin Rd., Apt. F-26, Parsippany, N.J. 07054

[21] Appl. No.: 878,615

[22] Filed: Jun. 19, 1997

[51] Int. Cl.[6] ..... A63B 22/02; A63B 22/04; A63B 22/12

[52] U.S. Cl. ..... 482/51; 482/54; 482/52; 482/62

[58] Field of Search ..... 482/51, 54, 52, 482/53, 62

[56] References Cited

U.S. PATENT DOCUMENTS

| | | | |
|---|---|---|---|
| 4,693,468 | 9/1987 | Kurlytis et al. | 482/62 |
| 4,902,002 | 2/1990 | Huang | 482/62 |
| 5,162,029 | 11/1992 | Gerard | 482/54 |
| 5,176,597 | 1/1993 | Bryne | 482/54 |
| 5,199,933 | 4/1993 | Illuzzi | 482/62 |
| 5,265,589 | 11/1993 | Wang | 482/62 |
| 5,354,249 | 10/1994 | Raley | 482/62 |
| 5,407,408 | 4/1995 | Wilkinson | 482/54 |
| 5,492,521 | 2/1996 | Wilkinson et al. | 482/54 |
| 5,501,647 | 3/1996 | Synder | 482/52 |

*Primary Examiner*—Lynne A. Reichard
*Attorney, Agent, or Firm*—Alfred C. Hill

[57] ABSTRACT

An abdominal and upper body exercise accessory for a lower body exercise apparatus comprising an adjustable arrangement detachably connected between a pair of spaced, substantially parallel arrangements secured to the lower body exercise apparatus. A cylindrical member is secured to the adjustable arrangement centrally thereof and extending upwardly perpendicular thereto. A longitudnal, rotatable member is rotatably secured centrally to the cylindrical member and in a spaced relationship with the adjustable arrangement. A pair of spaced rotatable members are each disposed adjacent opposite ends of the longitudnal, rotatable member grippable by hands of an exerciser to enable exercising abdominal muscles and upper body muscles in conjunction with exercising lower body muscles with the lower body exercise apparatus. An adjustable resistance device is coupled to the cylindrical member and the longitudnal, rotatable member to enable adjustment of the resistance to turning the longitudnal, rotatable member and, therefore, the exertion expended by the exerciser.

19 Claims, 2 Drawing Sheets

EXERCISE APPARATUS ACCESSORY

BACKGROUND OF THE INVENTION

The present invention relates to exercising apparatus and more particularly to primarily abdominal and secondarily upper body exercise accessory for a lower body exercise apparatus involving counter and alternating movement of upper and lower extremities, i.e. left arm with right leg-right arm with left leg, as seen with a running motion.

Recently there has been a growing trend in the number of people using various types of exercise apparatus. The use of resistance in a work out has been found to rapidly tone and develop muscles, as well as to provide cardiovascular benefits.

There are on the market a number of devices that exercise the lower body muscle group as well as the upper body muscle group using, for instance, treadmills for the lower body muscle exerciser with arms attached thereto that enable the exerciser to exercise his arms and upper body muscular group. It should be noted that arm bar attachments currently seen on treadmills, for example, involve front to back motion only and exclude trunk rotation involving abdominal muscles.

It should be noted that because of the trend for a healthier lifestyle and exercise there has been purchased in the past a number of lower body exercising apparatus, such as treadmills, stationary bicycles and stair steppers, which exercise only the lower body muscles. To enable the exercise of the upper body muscles, a person would have to discard their presently owned lower body exercise apparatus and purchase new exercise apparatus that will exercise both the upper body and the lower body muscles, but not the abdominal muscles. This could be a rather high expenditure for a person desiring to maintain a healthy lifestyle by exercising using the exercise apparatus now on the market and yet not obtain the benefit of abdominal muscle exercise.

SUMMARY OF THE INVENTION

An object of the present invention is to provide an accessory for a lower body exercise apparatus that will exercise the abdominal and upper body muscles using lower body exercise apparatus already on hand.

Another object of the present invention is to provide an abdominal and upper body exercise accessory for a lower body exercise apparatus.

Still another object of the present invention is to provide an abdominal and upper body exercise accessory for a lower body exercise apparatus such as a treadmill, a stationary bicycle and a stair stepper.

A feature of the present invention is the provision of an abdominal and upper body exercise accessory for a lower body exercise apparatus comprising a lower body exercise apparatus having a pair of spaced, substantially parallel means capable of being gripped by both hands of an exerciser, each of the spaced, substantially parallel means being disposed adjacent a different side of the lower body exercising apparatus; an adjustable arrangement detachably connected between the pair of spaced, substantially parallel means; a cylindrical member having one end thereof secured to the adjustable arrangement centrally thereof and extending upwardly perpendicular thereto; a longitudnal, rotatable member rotatably secured adjacent a center thereof to the other end of the cylindrical member in spaced relation with the adjustable arrangement; a pair of spaced rotatable members each disposed adjacent opposite ends of the longitudnal, rotatable member grippable by hands of the exerciser to enable exercising upper body muscles and abdominal muscles in conjunction with exercising lower body muscles with the lower body exercise apparatus; and adjustable resistance means coupled to the cylindrical member and the longitudnal, rotatable member to enable adjustment of the resistance to turning the longitudnal, rotatable member and, therefore, the exertion expended by the exerciser.

BRIEF DESCRIPTION OF THE DRAWING

Above mentioned and other features and objects of the present invention will become more apparent by reference to the following description taken in conjunction with the accompanying drawing, in which.

DESCRIPTION OF THE PREFERRED EMBODIMENT

Figure 1:
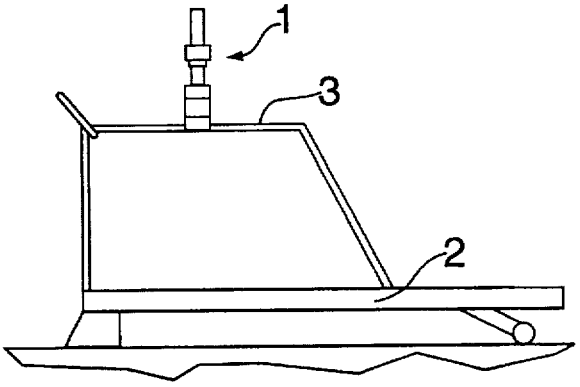
FIG. 1 is a side view of a treadmill incorporating the abdominal and upper body exercise accessory in accordance with the principles of the present invention.
Figure 2:
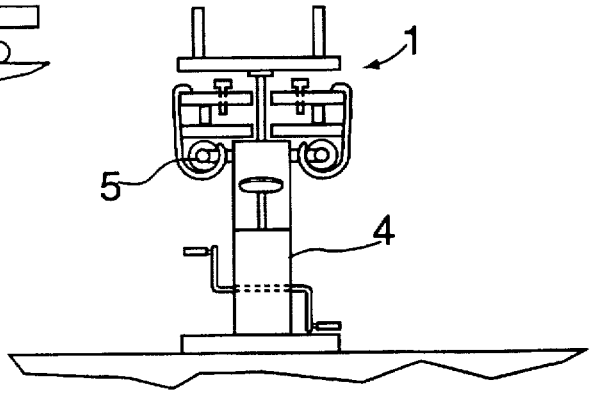
FIG. 2 is an end of a stationary bicycle incorporating the abdominal and upper body exercise accessory in accordance with the principles of the present invention.
Figure 3:
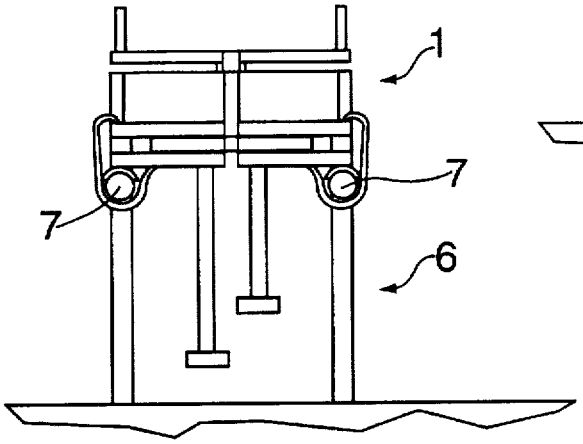
FIG. 3 is a front view of a stair stepper incorporating the abdominal and upper body exercise accessory in accordance with the principles of the present invention.

Referring to FIGS. 1–3, there is illustrated therein the abdominal and upper body exercise accessory 1 for three different types of lower body exercise apparatus. In FIG. 1 the abdominal and upper body exercise accessory 1 is associated with a treadmill 2 having side rails, or handrails 3 on opposite sides of the treadmill 2 to enable the exerciser to grab these rails to stabilize themselves particularly at higher speeds of the treadmill 2. The abdominal and upper body exercise accessory 1 is fastened to the side rails 3.

In FIG. 2 the lower body exercise apparatus is illustrated as being a stationary bicycle 4 having a pair of handlebars 5 substantially parallel with respect to each other which would be gripped by the hands of the exerciser.

The abdominal and upper body exercise accessory 1 is fastened to and supported by the handlebars 5.

In FIG. 3 the lower body exercising apparatus is illustrated as being stair stepper 6 having a pair of handrails 7 which are substantially parallel to one another and employed by the exerciser to assist in operating the stair stepper to exercise the lower body muscles. The abdominal and upper body exercise accessory 1 is detachably secured to the handrails 7 to exercise the abdominal and upper body muscles.

In each of the arrangements in FIGS. 1–3 the abdominal muscles are exercised by the fact that when the left arm moves accessory 1, the right foot is stepped on the device of the lower body exercising apparatus and, conversely, when the right arm is moved the left foot steps on the apparatus of FIGS. 1–3 and as a result the abdominal area is turned or twisted which exercises the abdominal muscles.

Figure 4:
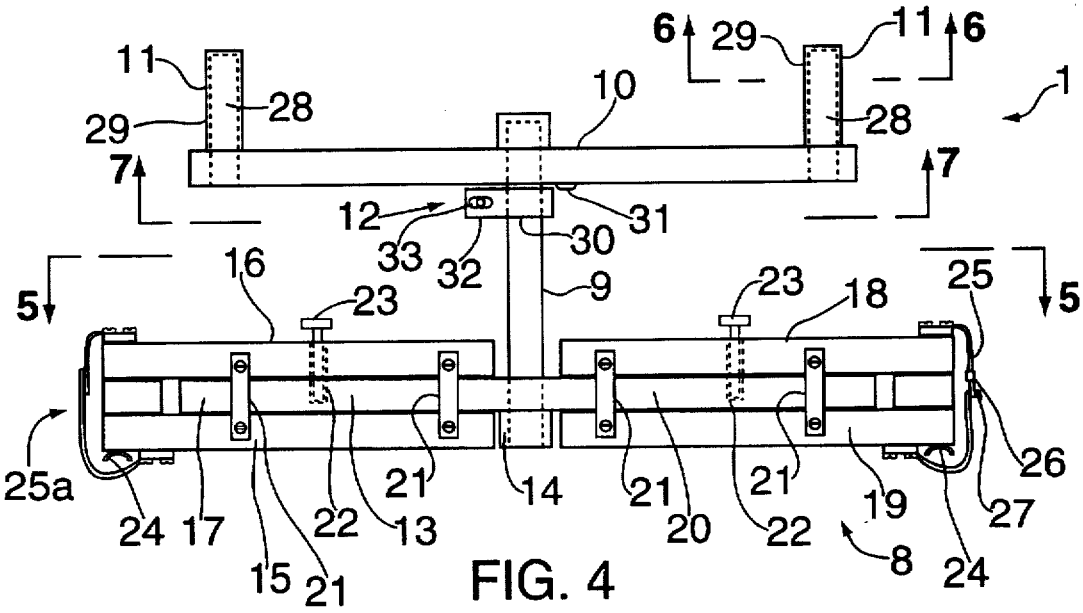
FIG. 4 is a detailed elevational view of the abdominal and upper body exercise accessory in accordance with the principles of the present invention.
Figure 5:
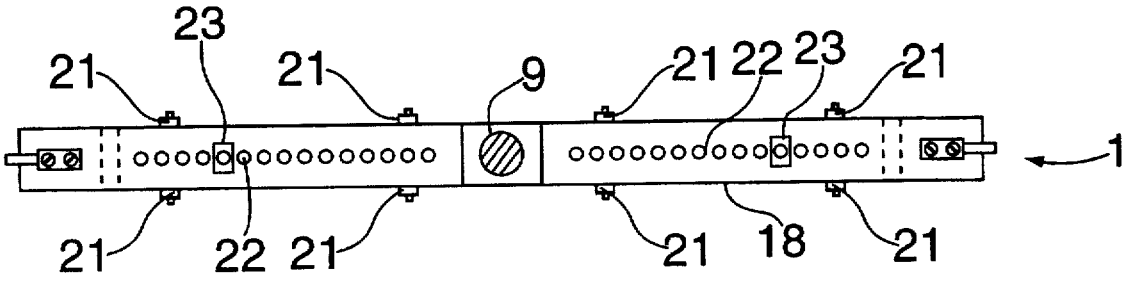
FIG. 5 is a plan view taken along line 5—5 of FIG. 4.
Figure 6:
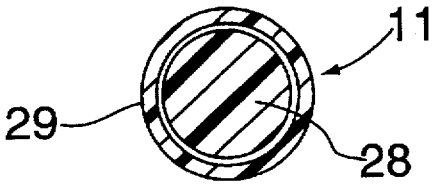
FIG. 6 is a cross-sectional view taken along line 6—6 of FIG. 4.

Referring to FIGS. 4, 5, and 6, there is illustrated therein the abdominal and upper body exercise accessory in accordance with the principles of the present invention. The abdominal and upper body exercise accessory 1 includes an adjustable arrangement 8 detachably connected between the pair of spaced, substantially parallel arrangements, such as the handrails 3 and 7 of FIGS. 1 and 3 and the handlebars 5 of FIG. 2. A cylindrical member 9 is secured at one end thereof to the adjustable arrangement 8 centrally thereof and extending upwardly perpendicular thereto. A longitudnal, rotatable member 10 is rotatably secured to the other end of cylindrical member 9 adjacent the center of member 10 and in a spaced relationship with adjustable arrangement 8. A pair of spaced rotatable members 11 are each disposed adjacent opposite ends of the longitudnal, rotatable member 10 grippable by hands of the exerciser to enable exercising abdominal and upper body muscles in conjunction with exercising lower body muscles with the lower body exercising apparatus. An adjustable resistance means, such as the device 12 is coupled to cylindrical member 9 and the longitudnal, rotatable member 10 to enable adjustment of the resistance to turning the longitudnal, rotatable member 10 and, thereby, the exertion expended by the exerciser.

The adjustable arrangement 8 includes a first member 13 to which one end of the cylindrical member 9 is secured at 14. A first pair of spaced longitudnal members 15 and 16 sandwiches one portion 17 of the first longitudnal member 13 therebetween, spaced from and to one side of cylindrical member 9 and a second pair of spaced, longitudnal members 18 and 19 sandwiches another portion 20 of the first longitudnal member 13 therebetween, spaced from and to the other side of the cylindrical member 9. The first and second pair of spaced, longitudnal members 16, 17 and 18, 19 are adjustable longitudinally with respect to the first longitudnal member 13 to accommodate different distances between the pair of spaced, substantially parallel means of the lower body exercise apparatus, such as the handrails 3 of the treadmill 2, the handlebars 5 of the stationary bicycle 4 and the handrails 7 of the stair stepper 6 of FIG. 3. To help maintain the member 13 and pair of members 15, 16, and 18, 19 in a proper orientation with respect to each other, a pair of brackets on opposite sides of these units, such as brackets 21, are provided extending between the pairs of members 15 and 16 and 18 and 19 to maintain a stable unit. If these brackets are not provided then the units could easily separate one from the other and become ineffective.

As clearly illustrated in FIG. 5, a plurality of holes 22 extend through a top most one of the first and second pair of spaced longitudnal members 15, 16 and 18, 19 and part way through the first longitudnal member 13. A pair of locking members 23 each associated with a different one of the first and second pair of spaced longitudnal members 15, 16 and 18, 19 engage selected ones of the plurality of holes 22 to lock movement of the first and second pairs of spaced, longitudnal members 15, 16, and 18, 19 relative to the first longitudnal member 13 after the adjustable arrangement 8 has been adjusted to accommodate the distance between the pair of spaced, substantially parallel means of the lower body exercise apparatus.

The adjustable arrangement 8 further includes a pair of semicircular members 24 each secured adjacent a different end of the lower most one of the first and second pair of spaced members 15, 16 and 18, 19, namely, on the lower most member 15 and 19 of these first and second pair of spaced, longitudnal members. These semicircular members 24 engage an associated one of the pair of spaced, substantially parallel means of the lower body exercise apparatus. To assist in securing the adjustable arrangement 8 to the pair of spaced, substantially parallel means of the lower body exercise apparatus, a pair of adjustable and disconnectable strap arrangements are each coupled between the lower most and upper most members of a different one of the first and second pair of spaced, longitudnal members 15, 16 and 18, 19 adjacent the ends thereof to wrap around an associated one of the pair of spaced, substantially parallel means of the lower body exercise apparatus to hold the accessory 1 in position thereon.

As illustrated in FIG. 4, there are two strap arrangements that can be employed, namely, a strap member 25 which includes an adjustable buckle arrangement 26 with the strap portion 27 being pulled through a loop in buckle 26 so as to adjust the tension on the strap member 25.

An alternative strap 25*a* employing Velcro strips can also be employed as the strap members 25 or 25*a*.

As illustrated in detail in FIG. 6, each of the pair of spaced rotatable members 11 include a cylindrical post 28 secured to the longitudnal, rotatable member 10 adjacent an associated end thereof extending perpendicular upwardly therefrom and a member 29 enclosing cylindrical post 28 in a rotational relationship therewith capable of being gripped by as associated one of the hands of the exerciser.

The adjustable resistance means 12 includes a brake member 30 encircling cylindrical member 9 adjacent the other end thereof and fastened to the longitudnal, rotatable member 10 at 31 by a screw or the like. Adjacent a split in the brake member 30 is provided a pair of spaced, outwardly extending portions 32. A bolt and wing nut combination 33 associated with the portions 32 enable adjusting the braking bit effect of the brake member 30 on the cylindrical member 9 to thereby adjust the resistance to turning the longitudnal, rotatable member 10.

Figure 7:
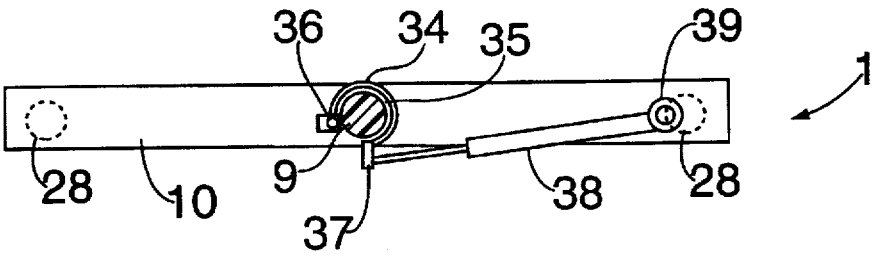
FIG. 7 is a view taken along line 7—7 of FIG. 4 illustrating an alternative adjustable resistance means in accordance with the principles of the present invention.

Referring to FIG. 7, there is illustrated therein an alternative adjustable resistance means to that shown in FIG. 4, but is similar thereto. The only difference between the FIG. 4 and FIG. 7 adjustable resistance means is the manner in which the brake member is adjusted to increase or decrease the braking effect thereof on the cylindrical member 9. Rather then encircling the member 9 as in FIG. 4, the brake member 34 of the embodiment of FIG. 7 only partially encircles the cylindrical member 9 at the other end thereof. As shown in FIG. 7 one end of the brake member 34 having a brake lining 35 is fastened to member 10 at 36 and includes an outwardly extending portion 37. An adjustable piston arrangement 38 has one end secured to the longitudnal, rotatable member 10 at 39 and the other end secured to the outwardly extending portion 37. The adjustable piston arrangement 38 has an adjustable throw to enable adjustment of the braking effect of brake member 34 on the cylindrical member 9 to thereby adjust the resistance to turning the longitudnal, rotatable member 10.

The accessory 1 in accordance with the principles of the present invention can be provided by plastic material, or lightweight metal materials, such as aluminum or a combination thereof, to provide a lightweight easily interchanged unit to be provided as an accessory to lower body exercise apparatus to enable the exercising of the abdominal muscles, upper body muscles and the lower body muscles.

While I have described above the principles of my invention in connection with specific apparatus, it is to be clearly understood that this description is made only by way of example and not as a limitation to the scope of my invention as set forth in the objects thereof and in the accompanying claim.

I claim:

1. An abdominal and upper body exercise accessory for a lower body exercise apparatus comprising:

a lower body exercise apparatus having a pair of spaced, substantially parallel means capable of being gripped by both hands of an exerciser, each of said spaced, substantially parallel means being disposed adjacent a different side of said lower body exercise apparatus;

an adjustable arrangement detachably connected between said pair of spaced, substantially parallel means;

a cylindrical member having one end thereof secured to said adjustable arrangement centrally thereof and extending upwardly perpendicular thereto;

a longitudnal, rotatable member rotatably secured adjacent a center thereof to the other end of said cylindrical member in a spaced relationship with said arrangements a pair of spaced rotatable members each disposed adjacent opposite ends of said longitudnal, rotatable member grippable by hands of said exerciser to enable exercising upper body muscles and abdominal muscles in conjunction with exercising lower body muscles with said lower body exercising apparatus and adjustable resistance means coupled to said cylindrical member and said longitudnal, rotatable member to enable adjustment of the resistance to turning said longitudnal, rotatable member and, therefore, the exertion expanded by said exerciser.

2. An accessory according to claim 1, wherein, said adjustable arrangement includes a first longitudnal member to which said cylindrical member is secured;

a first pair of spaced, longitudnal members sandwiching one portion of said first longitudnal member therebetween spaced from and to one side of said cylindrical member;

a second pair of spaced longitudnal members sandwiching another portion of said first longitudnal member therebetween spaced from and to the other side of said cylindrical member;

said first and second pair of spaced, longitudnal members being adjustable longitudinally with respect to said first longitudnal member to accommodate different distances between said pair of spaced, substantially parallel means of said lower body exercise apparatus.

3. An accessory according to claim 2, wherein said adjustable arrangement further includes a first plurality of holes extending through a top most one of said first and second pair of spaced, longitudnal members;

a second plurality of holes extending at least part way into said first longitudnal member; and a pair of locking members each associated with a different one of said first and second pair of spaced, longitudnal members to engage selected ones of said first and second plurality of holes to lock movement of said first and second pair of spaced, longitudnal members relative to said first longitudnal member after said adjustable arrangement has been adjusted to accommodate said distance between said pair of spaced, substantially parallel means of said lower body exercise apparatus.

4. An accessory according to claim 3, wherein said adjustable arrangement further includes a pair of semi-circular members each secured adjacent an end of a lower most one of said first and second pair of spaced, longitudnal members spaced from said cylindrical member to engage an associated one of said pair of spaced, substantially parallel means of said lower body exercise apparatus; and a pair of adjustable strap means each coupled between said upper most and said lower most of a different one of said first and second pair of spaced, longitudnal members adjacent said end thereof to engage said associated one of said pair of spaced, substantially parallel means of said lower body exercise apparatus to hold said accessory in position thereon.

5. An accessory according to claim 4, wherein each of said pair of spaced rotatable members includes a cylindrical post secured to said longitudnal, rotatable member adjacent an associated end thereof extending perpendicular upwardly therefrom; and a member enclosing said cylindrical post in a rotational relationship therewith capable of being gripped by an associated one of said hands of said exerciser.

6. An accessory according to claim 5, wherein said adjustable resistance means includes a brake member encircling said cylindrical member adjacent said other end thereof and fastened to said longitudnal, rotatable member, said brake member having a pair of spaced, outwardly extending portions adjacent a split in said brake member; and a bolt and wing nut cooperating with said pair of spaced, outwardly extending portions to enable adjusting the braking effect of said brake member on said cylindrical member to thereby adjust the resistance to turning said longitudnal, rotatable member.

7. An accessory according to claim 6, wherein said lower body exercise apparatus is a treadmill;

said pair of spaced substantially parallel means include a pair of treadmill handrails each disposed on opposite sides of said treadmill.

8. An accessory according to claim 6, wherein said lower body exercise apparatus is a stationary bicycle; and said pair of spaced, substantially parallel means include a pair of handlebars each disposed on opposite sides of said stationary bicycle.

9. An accessory according to claim 6, wherein said lower body exercise apparatus is a stair stepper; and said pair of spaced, substantially parallel means include a pair of stair stepper handrails each disposed on opposite sides of said stair stepper.

10. An accessory according to claim 5, wherein said adjustable resistance means includes a brake member disposed adjacent and partially encircling said cylindrical member adjacent said other end thereof and secured to said longitudnal, rotatable member, said brake member having an outwardly extending portion; and an adjustable piston means having one end secured to said longitudnal, rotatable member and the other end secured to said outwardly extending portion, said adjustable piston means having an adjustable throw to enable adjustment of the braking effect of said brake member on said cylindrical member to thereby adjust the resistance to turning said longitudnal, rotatable member.

11. An accessory according to claim 10, wherein said lower body exercise apparatus is a treadmill; and said pair of spaced, substantially parallel means include a pair of treadmill handrails each disposed on opposite sides of said treadmill.

12. An accessory according to claim 10, wherein said lower body exercise apparatus is a stationary bicycle; and said pair of spaced, substantially parallel means include a pair of handlebars each disposed on opposite sides of said stationary bicycle.

13. An accessory according to claim 10, wherein said lower body exercise apparatus is a stair stepper; and said pair of spaced, substantially parallel means include a pair of stair stepper handrails each disposed on opposite sides of said stair stepper.

14. An accessory according to claim 1, wherein each of said pair of spaced rotatable members includes a cylindrical post secured to said longitudnal, rotatable member adjacent an associated end thereof extending perpendicular upwardly therefrom; and a member enclosing said cylindrical post in a rotational relationship therewith capable of being gripped by an associated one of hands of said exerciser.

15. An accessory according to claim 1, wherein said adjustable resistance means includes a brake member encircling said cylindrical member adjacent said other end thereof and fastened to said longitudnal, rotatable member, said brake member having a pair of spaced, outwardly extending portions adjacent a split in said brake member; and a bolt and wing nut cooperating with said pair of spaced, outwardly extending portions to enable adjusting the braking effect of said brake member on said cylindrical member to thereby adjust the resistance to turning said longitudnal, rotatable member.

16. An accessory according to claim 1, wherein said lower body exercise apparatus is a treadmill; and said pair of spaced, substantially parallel means include a pair of treadmill handrails each disposed on opposite sides of said treadmill.

17. An accessory according to claim 1, wherein said lower body exercise apparatus is a stationary bicycle; and said pair of spaced, substantially parallel means include a pair of handlebars each disposed on opposite sides of said stationary bicycle.

18. An accessory according to claim 1, wherein said lower body exercise apparatus is a stair stepper; and said pair of spaced, substantially parallel means include a pair of stair stepper handrails each disposed on opposite sides of said stair stepper.

19. An accessory according to claim 1, wherein said adjustable resistance means includes a brake member disposed adjacent and partially encircling said cylindrical member adjacent said other end thereof and secured to said longitudnal, rotatable member, said brake member having an outwardly extending portion; and an adjustable piston means having one end secured to said longitudnal, rotatable member and other end secured to said outwardly extending portion, said adjustable piston means having an adjustable throw to enable adjustment of the braking effect of said brake member on said cylindrical member to thereby adjust the resistance to turning said longitudnal, rotatable member.

* * * * *